US012018431B2

(12) United States Patent
Matolyak et al.

(10) Patent No.: US 12,018,431 B2
(45) Date of Patent: Jun. 25, 2024

(54) METHODS OF COATING FIBER CONTAINING MATERIALS AND COATED FIBER CONTAINING MATERIALS

(71) Applicant: PPG Industries Ohio, Inc., Cleveland, OH (US)

(72) Inventors: Lindsay Elise Matolyak, Allison Park, PA (US); Venkateshwarlu Kalsani, Gibsonia, PA (US); Roxalana Lee Martin, Pittsburgh, PA (US); LuAnn Holsing, Saxonburg, PA (US); Shanti Swarup, Allison Park, PA (US); Benjamin Kabagambe, Cheswick, PA (US); Ronald James Kralic, Jr., Beaver Falls, PA (US); Irina G. Schwendeman, Wexford, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 120 days.

(21) Appl. No.: 17/428,808

(22) PCT Filed: Feb. 7, 2020

(86) PCT No.: PCT/US2020/017336
§ 371 (c)(1),
(2) Date: Aug. 5, 2021

(87) PCT Pub. No.: WO2020/163798
PCT Pub. Date: Aug. 13, 2020

(65) Prior Publication Data

US 2022/0127783 A1 Apr. 28, 2022

Related U.S. Application Data

(60) Provisional application No. 62/803,127, filed on Feb. 8, 2019.

(51) Int. Cl.
*D06M 15/263* (2006.01)
*D06M 11/79* (2006.01)
(Continued)

(52) U.S. Cl.
CPC ..... *D06M 15/263* (2013.01); *D06M 15/564* (2013.01); *D06M 15/568* (2013.01);
(Continued)

(58) Field of Classification Search
CPC ..... B32B 2264/403; B32B 27/18; D06M 15/263; D06M 15/564; D06M 15/568;
(Continued)

(56) References Cited

U.S. PATENT DOCUMENTS 4,738,757 A 4/1988 Naarmann
5,562,966 A 10/1996 Clarke et al.
(Continued)

FOREIGN PATENT DOCUMENTS

CN 103572351 A 2/2014
EP 0420655 A2 4/1991
(Continued)

OTHER PUBLICATIONS

Gardner, "Colored carbon fiber", Composites World, May 21, 2015, pp. 1-6, https://www.compositesworld.com/articles/colored-carbon-fiber.

(Continued)

*Primary Examiner* — Jennifer A Steele
(74) *Attorney, Agent, or Firm* — Krisanne Shideler

(57) ABSTRACT

A method for coating a material having a plurality of fibers includes treating at least a portion of the fibers by applying a liquid solution over at least a portion of the fibers of the material in which the liquid solution includes a polymer dispersed in a liquid medium, drying at least a portion of the liquid solution applied over the fibers of the material to
(Continued)

obtain a dried polymeric material that forms a network of discontinuous dried polymeric particles over the fibers, applying to at least a portion of the fibers a first coating composition comprising a film-forming resin that interacts with the dried polymeric material, and drying the first coating composition to form a first coating layer over at least a portion of the fibers. A coated material is also included.

18 Claims, 5 Drawing Sheets

(51) Int. Cl.
*D06M 15/564* (2006.01)
*D06M 15/568* (2006.01)
*D06M 23/12* (2006.01)
*D06M 101/40* (2006.01)

(52) U.S. Cl.
CPC ..... *D06M 23/12* (2013.01); *D06M 11/79* (2013.01); *D06M 2101/40* (2013.01)

(58) Field of Classification Search
CPC .. D06M 2101/40; D06M 23/08; D06M 23/12; D06M 11/79; D06P 3/80; C08J 3/126; D06N 2205/10; D06N 3/0068; Y10T 44/2231; Y10T 442/2082; Y10T 442/2115
See application file for complete search history.

(56) References Cited

U.S. PATENT DOCUMENTS

| | | | |
|---|---|---|---|
| 6,159,602 | A | 12/2000 | Kadokura et al. |
| 6,419,981 | B1 | 7/2002 | Novich et al. |
| 7,790,637 | B2 | 9/2010 | DiFonzo et al. |
| 8,070,918 | B2 | 12/2011 | Suzuki et al. |
| 8,562,886 | B2 | 10/2013 | DiFonzo et al. |
| 9,534,141 | B2 | 1/2017 | Ambrose et al. |
| 9,688,876 | B2 | 6/2017 | Ambrose et al. |
| 2002/0182957 | A1 | 12/2002 | Levenda |
| 2009/0110872 | A1 | 4/2009 | DiFonzo et al. |
| 2011/0206945 | A1 | 8/2011 | Seidler et al. |
| 2014/0037919 | A1 | 2/2014 | Plagemann et al. |
| 2016/0193820 | A1 | 7/2016 | Street |
| 2019/0002709 | A1 * | 1/2019 | Xu ..... C08F 283/006 |
| 2019/0161640 | A1 * | 5/2019 | Gottumukkala ..... B05D 7/572 |
| 2020/0290086 | A1 * | 9/2020 | Xu ..... C08G 18/755 |

FOREIGN PATENT DOCUMENTS

| | | | | |
|---|---|---|---|---|
| EP | 1457466 | A2 | 9/2004 | |
| EP | 3016800 | A0 | 11/2014 | |
| EP | 2886590 | A1 | 6/2015 | |
| GB | 2464539 | A | 4/2010 | |
| GB | 2516157 | A | 1/2015 | |
| GB | 2535291 | A | 8/2016 | |
| GB | 2552346 | A | 1/2018 | |
| JP | 2001260301 | A | 9/2001 | |
| JP | 2004506789 | A * | 3/2004 | ..... C08G 75/23 |
| KR | 1020140143923 | A | 12/2014 | |
| TW | 201202046 | A * | 1/2012 | ..... B32B 5/26 |
| WO | 2008103222 | A1 | 8/2008 | |
| WO | 2014181114 | A1 | 11/2014 | |
| WO | 2016041895 | A1 | 3/2016 | |
| WO | WO-2017160398 | A1 * | 9/2017 | ..... B05D 3/0254 |
| WO | 2018015757 | A1 | 1/2018 | |
| WO | WO-2018022780 | A1 * | 2/2018 | ..... B05D 7/572 |

OTHER PUBLICATIONS

Zhou et al., "Fabrication of Structurally-Colored Fibers with Axial Core-Shell Structure via Electrophoretic Deposition and Their Optical Properties", ACS Macro Letters, 2013, pp. 116-120, vol. 2, ACS Publications.

* cited by examiner

METHODS OF COATING FIBER CONTAINING MATERIALS AND COATED FIBER CONTAINING MATERIALS

FIELD OF THE INVENTION

The present invention relates to methods of coating fiber containing materials and coated fiber containing materials.

BACKGROUND OF THE INVENTION

Fiber containing materials, such as for example woven materials prepared from carbon fibers, are typically coated prior to further processing (e.g. molding the materials into an article) in order to provide a color, protective layer, and/or other desired property to the final product. However, the fibers of these materials often dislodge or deform during the coating process. The fibers can also lose their desired flexibility after being coated. It is therefore desirable to provide a process of coating fiber containing materials that overcomes the drawbacks associated with currently known coating processes for such materials.

SUMMARY OF THE INVENTION

The present invention relates to a method of coating a material comprising a plurality of fibers, the method includes: (a) applying a liquid solution over at least a portion of the fibers of the material, wherein the liquid solution comprises a polymer dispersed in a liquid medium; (b) drying at least a portion of the liquid solution applied over the fibers of the material to obtain a dried polymeric material that forms a network of discontinuous dried polymeric particles over the fibers; (c) applying to at least a portion of the fibers a first coating composition comprising a film-forming resin that interacts with the dried polymeric material; and (d) drying the first coating composition to form a first coating layer over at least a portion of the fibers.

The present invention also relates to a coated material comprising: a plurality of fibers comprising a dried polymeric material that forms a network of discontinuous dried polymeric particles over the fibers; and a first coating layer formed over at least a portion of the dried polymeric material of the fibers, in which the first coating layer is formed from a coating composition comprising a film-forming resin that interacts with the dried polymeric material to improve at least adhesion of the first coating layer over the plurality of fibers.

DESCRIPTION OF THE INVENTION

Figure 1:
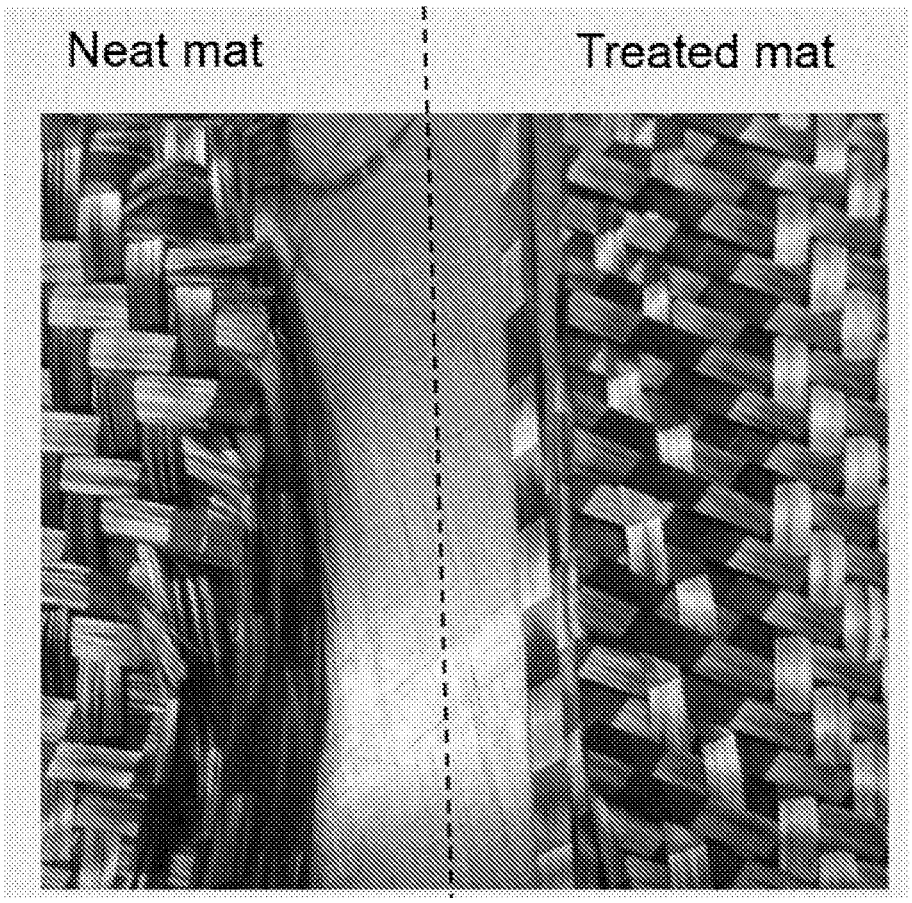
FIG. 1 is a perspective view of an image of woven materials cut with a blade for visually inspecting fraying between an untreated woven material and woven material treated according the present invention.

For purposes of the following detailed description, it is to be understood that the invention may assume various alternative variations and step sequences, except where expressly specified to the contrary. Moreover, other than in any operating examples, or where otherwise indicated, all numbers expressing, for example, quantities of ingredients used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. Further, in this application, the use of "a" or "an" means "at least one" unless specifically stated otherwise. For example, "a" polymer, "a" coating composition, and the like refer to one or more of any of these items.

As previously described, the present invention relates to a method for coating a material comprising a plurality of fibers. A "plurality of fibers" refers to greater than 2 fibers, such as greater than 3 fibers, or greater than 5 fibers, or greater than 10 fibers. Non-limiting examples of suitable fibers include carbon fibers, glass fibers, aramid fibers, Kevlar fibers, polyester fibers, fiberglass, polypropylene fibers, flax linen fibers, nylon fibers, composite fibers, fibers that are metallized (i.e. have a metallic material or coating formed over at least a portion of the fibers such as metallized carbon fibers, for example carbon fibers with aluminum applied over a portion of the carbon fibers), non-metallized fibers, and combinations and hybrids thereof.

The material can be formed from a plurality of fibers that are associated together to form any desired shape and/or size. For instance, the plurality of fibers can be associated together such that the fibers form a woven material, such as a woven mat. The fibers that form a woven material are associated together such as, for example, by interlacing, stacking, or the like. The fibers can also be associated in various patterns such as, for example, being associated in parallel and/or being crossed together.

As indicated, the method of the present invention includes treating at least a portion of the material comprising applying a liquid solution over at least a portion of the fibers. The liquid solution can be applied over at least a portion of the fibers using various methods. Non-limiting examples of suitable methods for applying the liquid solution include spraying, dipping, rolling, brushing, electrodepositing, and the like. For instance, the material comprising the plurality fibers, such as a woven material formed from a plurality of fibers, can be at least partially dipped into a bath that includes the liquid solution in order to apply the liquid solution over the fibers. The liquid solution can be applied over one or multiple sides of the fibers, such as over at least two opposite sides of the fibers).

The liquid solution that is used to treat the material comprises a polymer dispersed in a liquid medium. As used herein, the term "polymer" refers to oligomers and homopolymers (e.g., prepared from a single monomer species), copolymers (e.g., prepared from at least two monomer species), terpolymers (e.g., prepared from at least three monomer species) and graft polymers. Further, as used herein, the term "resin" is used interchangeably with the term "polymer." It is appreciated that monomers and/or macromers can also be dispersed in the liquid solution.

The liquid medium of the liquid solution can be an aqueous solution or a non-aqueous solution. As used herein, the term "aqueous" refers to a liquid medium comprising greater than 50 weight % water, based on the total weight of the liquid medium. Such aqueous liquid mediums can for example comprise at least 60 weight % water, or at least 70 weight % water, or at least 80 weight % water, or at least 90 weight % water, or at least 95 weight % water, or 100 weight % water, based on the total weight of the liquid medium. The aqueous medium optionally comprises one or more organic solvent(s) that make up less than 50 weight % of the liquid medium including organic solvents. Non-limiting examples of suitable organic solvents include polar organic solvents, e.g. protic organic solvents such as glycols, glycol ether alcohols, alcohols; and volatile ketones, glycol diethers, esters, and diesters. Other non-limiting examples of organic solvents include aromatic and aliphatic hydrocarbons.

"Non-aqueous" refers to a liquid medium comprising less than 50 weight % water, based on the total weight of the liquid medium. Such non-aqueous liquid mediums can comprise less than 40 weight % water, or less than 30 weight % water, or less than 20 weight % water, or less than 10 weight % water, or less than 5% water, based on the total weight of the liquid medium. The solvents that make up more than 50 weight % of the liquid medium include organic solvents such as any of the organic solvents previously described.

The polymers dispersed in the liquid solution can be selected from a variety of polymers including, but not limited to, (meth)acrylic polymers, polyurethanes, polyester polymers, polyamide polymers, polyether polymers, polysiloxane polymers, melamine resins, epoxy resins, vinyl resins, copolymers thereof, and copolymers, and combinations thereof. For example, the polymers dispersed in the liquid solution can comprise a polyurethane, a (meth)acrylic polymer, a polyurethane-(meth)acrylic copolymer, a melamine resin such as a methylated trimethylol melamine resin including for example the melamine resin commercially available from Allnex under the tradename Cymel® 385, and any combination thereof. As used herein, "(meth)acrylate" refers to both the methacrylate and the acrylate.

The polymers dispersed in the liquid solution can also have one or more functional groups. Non-limiting examples of functional groups include carboxylic acid groups, amine groups, epoxide groups, alkoxy groups, hydroxyl groups, thiol groups, carbamate groups, amide groups, urea groups, isocyanate groups (including blocked isocyanate groups), keto functional groups (also referred to as ketone functional groups), aldo functional groups (also referred to as aldehyde functional groups), ethylenically unsaturated groups, and combinations thereof. As used herein, "ethylenically unsaturated" refers to a group having at least one carbon-carbon double bond. Non-limiting examples of ethylenically unsaturated groups include, but are not limited to, (meth) acrylate groups, vinyl groups, and combinations thereof.

The polymers can also be selected to have certain linkages including, but not limited to, urea linkages, urethane linkages, ester linkages, ether linkages, and combinations thereof.

The polymers dispersed in the liquid solution can be in particulate or non-particulate form. For instance, the polymers can comprise: (1) core-shell polymeric particles such as (meth)acrylic-polyurethane core-shell particles and which comprise functional groups, for example keto and/or aldo functional groups, on the polyurethane shell and/or the acrylic core; (2) self-emulsifying dispersion polymers; or a combination thereof.

As used herein, a core-shell particle in which the core is at least partially encapsulated by the shell refers to a particle comprising (i) at least a first material or materials that form the center of the particle (i.e., the core) and (ii) at least a second material or materials (i.e., the shell) that form a layer over at least a portion of the surface of the first material(s) (i.e., the core). It is appreciated that the first material(s) that forms the core can be different from the second material(s) that forms the shell. Further, the core-shell particles can have various shapes (or morphologies) and sizes. For example, the core-shell particles can have generally spherical, cubic, platy, polyhedral, or acicular (elongated or fibrous) morphologies. The core-shell particles can also have an average particle size of 30 to 300 nanometers, or from 40 to 200 nanometers, or from 50 to 150 nanometers. As used herein, "average particle size" refers to volume average particle size. The average particle size can for example be determined with a Zetasize 3000HS following the instructions in the Zetasize 3000HS manual.

As indicated, the core-shell particles comprise a polymeric core as well as a polymeric shell. A "polymeric core" means that the core of the core-shell particle comprises one or more polymers and a "polymeric shell" means that the shell of the core-shell particle comprises one or more polymers.

The polymeric shell can be covalently bonded to at least a portion of the polymeric core. For example, the polymeric shell can be covalently bonded to the polymeric core by reacting at least one functional group on the monomers and/or prepolymers that are used to form the polymeric shell with at least one functional group on the monomers and/or prepolymers that are used to form the polymeric core. The functional groups can include any of the functional groups previously described provided that at least one functional group on the monomers and/or prepolymers that are used to form the polymeric shell is reactive with at least one functional group on the monomers and/or prepolymers that are used to form the polymeric core. For instance, the monomers and/or prepolymers that are used to form the polymeric shell and polymeric core can both comprise at least one ethylenically unsaturated group that are reacted with each other to form a chemical bond. As used herein, a "prepolymer" refers to a polymer precursor capable of further reactions or polymerization by one or more reactive groups to form a higher molecular mass or cross-linked state.

When the liquid medium of the liquid solution is an aqueous medium, the polymeric core and polymeric shell of the core-shell particles are also prepared to provide a hydrophilic polymeric shell with enhanced water-dispersibility/stability and a hydrophobic polymeric core. As used herein, the term "hydrophilic" refers to polymers, monomers, and other materials that have an affinity for water and which will disperse or dissolve in water or other aqueous based mediums (such as at ambient temperature, e.g. 23° C.). Hydrophilic materials, such as hydrophilic polymers, typically have water-dispersible groups. A "water-dispersible group" refers to a group having or formed from one or more hydrophilic functional groups that have an affinity for water and which help disperse a compound, such as a polymer, in water or other aqueous based mediums. Further, as used herein, the term "hydrophobic" refers to polymers, monomers, and other materials that lack an affinity for water or other aqueous based mediums and tend to repel, not dissolve or disperse in, and/or not be wetted by water or other aqueous based mediums. Hydrophobic materials, such as hydrophobic polymers, are often free of water-dispersible groups.

As indicated, the polymeric core and polymeric shell of the core-shell particles can be prepared to provide a hydrophilic polymeric shell with enhanced water-dispersibility/stability and a hydrophobic polymeric core. Thus, the polymeric shell can comprise hydrophilic water-dispersible groups while the polymeric core can be free of hydrophilic water-dispersible groups. The hydrophilic water-dispersible groups can increase the water-dispersibility/stability of the polymeric shell in an aqueous medium so that the polymeric shell at least partially encapsulates the hydrophobic core.

As previously described, water-dispersible groups comprise one or more hydrophilic functional groups. For example, polymer(s) that form the hydrophilic polymeric shell can comprise ionic or ionizable groups such as the carboxylic acid functional groups or salts thereof. The carboxylic acid functional groups can be at least partially neutralized (i.e., at least 30% of the total neutralization equivalent) by a base, such as a volatile amine, to form a salt group. A volatile amine refers as an amine compound having an initial boiling point of less than or equal to 250° C. as measured at a standard atmospheric pressure of 101.3 kPa. Examples of suitable volatile amines are ammonia, dimethylamine, trimethylamine, monoethanolamine, and dimethylethanolamine. It is appreciated that the airlines will evaporate during the formation of the coating to expose the carboxylic acid functional groups and allow the carboxylic acid functional groups to undergo further reactions. Other non-limiting examples of water-dispersible groups include polyoxyalkylene groups such as by using polyethylene/propylene glycol ether materials for example.

The core-shell particles can be formed from various polymeric materials including any of the polymers previously described. For example, (1) the polymeric core can comprise a (meth)acrylate polymer, a vinyl polymer, or a combination thereof, and (2) the polymeric shell can comprise a polyurethane. Such core-shell particles can be formed from isocyanate functional polyurethane prepolymers, polyamines, and ethylenically unsaturated monomers. Moreover, the backbone or main chain of the polyurethane polymer that forms at least a portion of the polymeric shell can comprise urea linkages in addition to the urethane linkages. The polymeric shell can also comprise additional linkages including, but not limited to, ester linkages, ether linkages, and combinations thereof.

It is appreciated that the polymeric core-shell particles can comprise any of the previously described functional groups. For instance, the polymeric core-shell particles can comprise carboxylic acid groups, hydroxyl groups, and/or keto or aldo groups. The functional groups can be on the shell and/or the core. For example, the functional groups can all be on the shell (e.g. carboxylic acid groups, hydroxyl groups, and/or keto or aldo groups), while the core is free of functional groups.

When the polymeric shell comprises a polyurethane with urea linkages and keto and/or aldo groups, the polymeric shell can be formed from polyurethane prepolymers and the Michael addition reaction products of a polyamine functional compound, such as a diamine, with keto and/or aldo containing ethylenically unsaturated monomers. The polyamine functional compound typically comprises at least two primary amino groups (i.e., a functional group represented by the structural formula —$NH_2$), and the keto and/or aldo containing unsaturated monomers include, but are not limited to, (meth)acrolein, diacetone (meth)acrylamide, diacetone (meth)acrylate, acetoacetoxyethyl (meth)acrylate, vinyl acetoacetate, crotonaldehyde, 4-vinylbenzaldehyde, and combinations thereof. The resulting Michael addition reaction products can include a compound with at least two secondary amino groups (i.e., a functional group represented by the structural formula —NRH in which R is a hydrocarbon) and at least two keto and/or aldo functional groups. It is appreciated that the secondary amino groups will react with the isocyanate functional groups of the polyurethane prepolymers to form urea linkages and chains extend the polyurethanes. Further, the keto and/or aldo functional groups will extend out from the backbone of the chain-extended polyurethane, such as from the nitrogen atom of the urea linkage, for example, to form a polyurethane with pendant keto and/or aldo functional groups.

As indicated, the polymer can comprise a self-emulsifying dispersion polymer. As used herein, a self-emulsifying dispersion polymer refers to a polymer that contains hydrophilic functionality and is not synthesized initially as an aqueous dispersion, but is then mixed with water to form an aqueous dispersion. The self-emulsifying dispersion polymer can comprise various types of polymers including, but not limited to, any of the previously described polymers, such as a polyurethane, that can include various functional groups and linkages, such as urea and urethane linkages.

It is appreciated that the liquid solution can comprise multiple types of polymers. For example, the liquid solution can comprise polymeric core-shell particles as previously described and one or more polyol polymers. As used, a "polyol" refers to a polymer having two or more hydroxyl groups, such as polyesters having two or more hydroxyl groups for example.

The polymers dispersed in the liquid solution can comprise at least 1 weight %, at least 5 weight %, or at least 10 weight % of the liquid solution, based on the total weight of the liquid solution. The polymers dispersed in the liquid solution can also comprise 30 weight % or less, 25 weight % or less, 20 weight % or less, 15 weight % or less, or 12 weight % or less of the liquid solution, based on the total weight of the liquid solution. The polymers dispersed in the liquid solution can also comprise an amount within a range, such as for example, from 1 weight % to 30, or from 1 weight % to 25, or from 1 weight % to 20 weight %, or from 5 weight % to 15 weight %, or from 8 weight % to 12 weight % of the liquid solution, based on the total weight of the liquid solution.

The liquid solution can also comprise additional components. For example, the liquid solution can also comprise a colorant. As used herein, "colorant" refers to any substance that imparts color and/or other opacity and/or other visual effect to the composition. The colorant can be added to the coating in any suitable form, such as discrete particles, dispersions, solutions, and/or flakes. A single colorant or a mixture of two or more colorants can be used in the coatings of the present invention.

Example colorants include pigments (organic or inorganic), dyes and tints, such as those used in the paint industry and/or listed in the Dry Color Manufacturers Association (DCMA), as well as special effect compositions. A colorant may include, for example, a finely divided solid powder that is insoluble, but wettable, under the conditions of use. A colorant can be organic or inorganic and can be agglomerated or non-agglomerated.

Example pigments and/or pigment compositions include, but are not limited to, carbazole dioxazine crude pigment, azo, monoazo, diazo, naphthol AS, benzimidazolone, isoindolinone, isoindoline and polycyclic phthalocyanine, quinacridone, perylene, perinone, diketopyrrolo pyrrole, thioindigo, anthraquinone, indanthrone, anthrapyrimidine, flavanthrone, pyranthrone, anthanthrone, dioxazine, triarylcarbonium, quinophthalone pigments, diketo pyrrolo pyrrole red ("DPPBO red"), titanium dioxide, carbon black, and mixtures thereof.

Example dyes include, but are not limited to, those that are solvent and/or aqueous based such as phthalo green or blue, iron oxide, bismuth vanadate, anthraquinone, and perylene and quinacridone.

Example tints include, but are not limited to, pigments dispersed in water-based or water miscible carriers such as AQUA-CHEM 896 commercially available from Degussa, Inc., and CHARISMA COLORANTS and MAXITONER INDUSTRIAL COLORANTS commercially available from Accurate Dispersions Division of Eastman Chemical, Inc.

The colorants can also be selected from polymer-enclosed color-imparting particles, such as polymer-enclosed organic and/or inorganic color-imparting particles. As used herein, the term "polymer-enclosed color-imparting particles" refers to color-imparting particles that are at least partially enclosed by, i.e., confined within, a polymer to an extent sufficient to physically separate color-imparting particles from each other within an aqueous dispersion, thereby preventing significant agglomeration of the particles. The dispersions often are oil-in-water emulsions, wherein an aqueous medium provides the continuous phase of the dispersion in which the polymer-enclosed color-imparting particles are suspended as the organic phase.

It is appreciated that the color-imparting particles enclosed by the polymers comprise non-polymeric color-imparting particles that can have various shapes and sizes. For example, the color-imparting particles can comprise non-polymeric nanoparticles. As used herein, the term "nanoparticles" refers to particles having an average primary particle size of no more than 300 nanometers. The organic pigment nanoparticles described herein can have an average primary particle size of less than 150 nanometers, such as less than 70 nanometers, or, in some cases, less than 30 nanometers. The dispersed particle size is the size of the individual particles (primary particles) or agglomerates of primary particles. Average particle size can be determined by visually examining an electron micrograph of a transmission electron microscopy ("TEM") image of a representative sample of the particles, measuring the diameter of the particles in the image, and calculating the average primary particle size of the measured particles based on magnification of the TEM image. One of ordinary skill in the art will understand how to prepare such a TEM image and determine the primary particle size based on the magnification.

The polymer-enclosed color-imparting particles may comprise, for example, a polymer selected from acrylic polymers, polyurethane polymers, polyester polymers, polyether polymers, silicon-based polymers, co-polymers thereof, and combinations thereof. Such polymers can be produced by any suitable method known to those skilled in the art to which the present invention pertains. Suitable polymers are also disclosed in United States Patent Application Publication No. 2005/0287348 at [0042] to [0044] and United States Patent Application Publication No. 2006/0251896 at paragraphs [0054] to [0079], which are incorporated by reference herein.

Suitable organic particles that can be used to form polymer-enclosed organic particles can include, for example, any of the organic pigments previously described. For instance, the organic pigment particles can comprise azo compounds (monoazo, di-azo, β-Naphthol, Naphthol AS salt type azo pigment flakes, benzimidazolone, di-azo condensation, isoindolinone, isoindoline), and polycyclic (phthalocyanine, quinacridone, perylene, perinone, diketopyrrolo pyrrole, thioindigo, anthraquinone, indanthrone, anthrapyrimidine, flavanthrone, pyranthrone, anthanthrone, dioxazine, triarylcarbonium, quinophthalone) pigments, and combinations thereof.

Suitable inorganic particles can comprise, for example, an inorganic material comprising aluminum, barium, bismuth, boron, cadmium, calcium, cerium, cobalt, copper, iron, lanthanum, magnesium, manganese, molybdenum, nitrogen, oxygen, phosphorus, selenium, silicon, silver, sulfur, tin, titanium, tungsten, vanadium, yttrium, zinc, and zirconium, including oxides thereof, nitrides thereof, phosphides thereof, phosphates thereof, selenides thereof, sulfides thereof, sulfates thereof, and mixtures thereof. Suitable non-limiting examples of the foregoing inorganic particles include alumina, silica, titania, ceria, zirconia, bismuth oxide, magnesium oxide, iron oxide, aluminum silicate, boron carbide, nitrogen doped titania, and cadmium selenide. The particles can comprise, for example, a core of essentially a single inorganic oxide, such as silica in colloidal, fumed, or amorphous form, alumina or colloidal alumina, titanium dioxide, iron oxide, cesium oxide, yttrium oxide, colloidal yttria, zirconia, e.g., colloidal or amorphous zirconia, and mixtures of any of the foregoing. It is appreciated that the color-imparting particles can provide a colored metallic look or other special effect type appearance when applied.

The aqueous dispersions of polymer-enclosed color-imparting particles can be prepared by any of a variety of methods. For example, the aqueous dispersion can be prepared by a method comprising (1) providing a mixture, in an aqueous medium, of (i) organic or inorganic particles, (ii) one or more polymerizable, ethylenically unsaturated monomers; and/or (iii) a mixture of one or more polymerizable unsaturated monomers with one or more polymers; and/or (iv) one or more polymers, and then (2) subjecting the admixture to high stress shear conditions in the presence of an aqueous medium to particularize the admixture into polymer-enclosed color-imparting particles.

The aqueous dispersions of polymer-enclosed color-imparting particles can also be made by a method comprising: (1) providing a mixture, in an aqueous medium, of (i) organic or inorganic particles, (ii) a polymerizable ethylenically unsaturated monomer, and (iii) a water-dispersible polymerizable dispersant, and (2) polymerizing the ethylenically unsaturated monomer and polymerizable dispersant to form polymer-enclosed color-imparting particles comprising a water-dispersible polymer. The polymerizable dispersant may comprise any polymerizable material that is water-dispersible and which, upon polymerization with the ethylenically unsaturated monomer, produces polymer-enclosed color-imparting particles comprising a water-dispersible polymer. The polymerizable dispersant can comprise a water-dispersible, polymerizable polyester polyurethane having terminal ethylenic unsaturation. The particles can be formed into nanoparticles during the polymerization. Such methods are described in detail in United States Patent Application Publication No. 2006/0247372 at paragraphs [0053] to [0058], which is incorporated herein by reference.

The aqueous dispersions of polymer-enclosed color-imparting particles can additionally be made by a method comprising: (1) providing a mixture, in an aqueous medium, of (i) organic or inorganic particles, and (ii) a polymerizable ethylenically unsaturated compound comprising a multi-functional ethylenically unsaturated monomer, and (2) polymerizing a portion of the multi-functional ethylenically unsaturated monomer to form a radiation curable aqueous dispersion of polymer-enclosed color-imparting particles.

Other non-limiting examples of components that can be added to the liquid solution of the present invention include plasticizers, fillers including, but not limited to, micas, talc, clays, and inorganic minerals, anti-oxidants, hindered amine light stabilizers, UV light absorbers and stabilizers, surfactants, flow and surface control agents, thixotropic agents, organic cosolvents, reaction inhibitors, and other customary auxiliaries.

The liquid solution can also comprise a platy inorganic filler, such as a platy inorganic filler dispersion. As used herein, a "platy inorganic filler" refers to an inorganic material in the platy form. The term "platy" refers to a structure in which one dimension is smaller (such as 2 times smaller or 3 times smaller) than the two other dimensions of the structure resulting in a flat type appearance. The platy inorganic fillers are generally in the form of stacked lamellae, sheets, or plates with a relatively pronounced anisometry. The platy inorganic fillers can further improve the wetting properties on the fibers.

Suitable platy inorganic fillers can include those having a high aspect ratio, for example. Suitable high aspect ratio platy inorganic fillers include, for example, vermiculite, mica, talc, wollastonite, chlorite, metal flakes, platy clays, and platy silicas. Such fillers typically have diameters of 1 to 20 microns, 2 to 5 microns, or 2 to 10 microns. The aspect ratio of the fillers can be at least 5:1, such as at least 10:1 or 20:1. For example, mica flakes may have an aspect ratio of 20:1, talc may have an aspect ratio of 10:1 to 20:1, and vermiculite may have an aspect ratio of from 200:1 to 10,000:1.

The liquid materials can also be substantially free, essentially free, or completely free of any of the additional materials such as a colorant. The terms "substantially free" means that the liquid solution contains less than 1000 parts per million (ppm) of an additional material such as a colorant, "essentially free" means that the liquid solution contains less than 100 ppm of an additional material such as a colorant, and "completely free" means that the liquid solution contains less than 20 parts per billion (ppb) of an additional material such as a colorant. The amounts are based on total weight of the liquid solution.

After applying the liquid solution over the fibers, the liquid solution is dried to form at least a dried polymeric material over at least a portion of the material comprising the fibers. As used herein, "drying" refers to the removal of water and/or other solvents. The liquid solution can be dried at ambient conditions such as for example with forced air at ambient conditions, or with heat. The term "ambient conditions" refers to the conditions of the surrounding environment (e.g., the temperature, humidity, and pressure of the room or outdoor environment in which the substrate is located such as, for example, at a temperature of 23° C. and at a relative humidity in the air of 35% to 75%).

It will be appreciated that the dried polymer material is formed from at least the polymer dispersed in the liquid solution (for example, (1) the core-shell polymeric particles; (2) the self-emulsifying dispersion polymers; or a combination thereof). The polymer dispersed in the liquid solution can be selected so that the dried polymeric material comprises a non-crosslinked polymeric material. That is, the polymers in the liquid solution that form the dried polymeric material do not react with themselves or other components in the liquid solution to form a crosslinked polymeric system such as a crosslinked coating layer. As such, the polymers dispersed in the liquid solution can be non-self-crosslinkable polymers, and the liquid solution can be substantially free, essentially free or completely free of a crosslinker reactive with the polymers dispersed in the liquid solution such that upon drying the liquid solution forms a non-crosslinked polymeric material.

As used herein, a "non-self-crosslinkable polymer" refers to a polymer that does not have functional groups that are reactive with each other, and the term "crosslinker" refers to a molecule comprising two or more functional groups that are reactive with other functional groups and which is capable of linking two or more monomers or polymer molecules through chemical bonds. Further, the terms "substantially free of a crosslinker reactive with the polymers dispersed in the liquid solution" means that the liquid solution contains less than 1000 parts per million (ppm) of a crosslinker reactive with the polymers dispersed in the liquid solution, "essentially free of a crosslinker reactive with the polymers dispersed in the liquid solution" means that the liquid solution contains less than 100 ppm of a crosslinker reactive with the polymers dispersed in the liquid solution, and "completely free of a crosslinker reactive with the polymers dispersed in the liquid solution" means that the liquid solution contains less than 20 parts per billion (ppb) of a crosslinker reactive with the polymers dispersed in the liquid solution. The amounts are based on total weight of the liquid solution.

It will be appreciated that additional components that are optionally included in the liquid solution can also be dried over the fibers along with the dried polymeric material. For instance, the liquid solution may also include one or more colorants, such as one or more pigments, or platy inorganic fillers, which can be dried over the material comprising the plurality of fibers along with the dried polymeric material.

As indicated, the liquid solution is applied to the plurality of fibers and dried to form at least dried polymeric material over a portion of the fibers. It was found that the dried polymeric material can form a network of discontinuous dried polymeric particles over the fibers. As used herein, a "network of discontinuous dried polymeric particles" refers to dried polymeric particle like materials formed over a surface of the fibers in which spaces or gaps are formed between at least some of the polymeric particles such that portions of the surface of the fibers are exposed (i.e. not covered by the dried polymeric material) and at least some of the voids formed between the fibers are not filled with the polymeric particles.

The dried polymeric particles can comprise various shapes, sizes, and morphologies. For example, the discontinuous dried polymeric particles can comprise discontinuous dried polymeric platelets. As used herein, "platelets" refer to a flat shaped particle. Further, the term "discontinuous dried polymeric platelets" refers to dried polymeric platelets formed over a surface of the fibers in which spaces or gaps are formed between at least some of the polymeric platelets such that portions of the surface of the fibers are exposed (i.e. not covered by the dried polymeric platelets) and at least some of the voids formed between the fibers are not filled with the polymeric platelets. The platelets can have a length and width about 2 to 5 times that of the thickness. The face of the platelets can range, for example, from 100 nanometers (nm) to 15 microns (μm), such as from 500 nm to 5 microns.

It was found that at lower concentrations of polymer in the liquid solution (e.g. from 1 to 10% by weight, based on the total weight of the liquid solution), the polymer can form a larger amount of separate particles with one or more morphologies. At increased polymer concentrations (e.g. from 15 to 30%, 15 to 25%, or 15 to 20% by weight, based on the total weight of the liquid solution), a larger amount of the particles may be fused together providing connection points such as between 3 or more individual fibers but which does not fill the voids between the fibers. At higher concentrations (e.g. greater than 30% by weight, based on the total weight of the liquid solution), the polymeric particles may begin to coalesce together and begin to fill the voids between fibers and form a continuous film, which has been found to decrease the desired properties that allows for later processing of the fiber containing material (e.g. later molding processes).

It will be appreciated that the dried polymeric particles are formed at least from the previously described polymer dispersed in the liquid solution (for example, (1) the core-shell polymeric particles; (2) the self-emulsifying dispersion polymers; or a combination thereof). The additional components that are optionally included in the liquid solution (e.g. colorants and/or platy inorganic fillers) can also be dried over the fibers to form a network of discontinuous dried materials, such as discontinuous dried particles for example.

It will be appreciated that when the plurality of fibers are used to form a woven material, the woven material can be formed before or after treatment with the liquid solution. The woven material can also be formed after application of the coating compositions further described herein.

The present invention can also include applying at least one coating composition over at least a portion of the dried polymeric materials. This coating composition can be a liquid coating composition or a powder coating composition. The coating composition can also be applied using any of the previously described methods. For instance, the coating composition can be a liquid coating composition that is sprayed over at least a portion of the dried polymeric material, or the coating composition can be a powder coating composition that is electrostatically sprayed over at least a portion of the dried polymeric material. The coating composition can be applied to multiple sides or only one side of the plurality of fibers, such as over multiple sides or only one side of a woven material.

The coating composition applied over the dried polymeric material comprises a film-forming resin that interacts with the dried polymeric material. As used herein, a "film-forming resin" refers to a self-supporting film on at least a horizontal surface of a substrate upon removal of any diluents or carriers present in the composition.

The film-forming resin can include any of a variety of thermoplastic and/or thermosetting resins known in the art. As used herein, the term "thermosetting" refers to resins that "set" irreversibly upon curing or crosslinking, wherein the polymer chains are joined together by covalent bonds. The terms "curable", "cure", and the like, mean that at least a portion of the components that make up the composition are polymerizable and/or crosslinkable including self-crosslinkable polymers. Further, as used herein, the term "thermoplastic" refers to resins that include polymeric components that are not joined by covalent bonds and, thereby, can undergo liquid flow upon heating.

The film-forming resin can be selected from a variety of resins including any of the previously described polymers. For example, the film-forming resin can include (meth) acrylic polymers, polyurethanes, polyester polymers, polyamide polymers, polyether polymers, polysiloxane polymers, epoxy resins, vinyl resins, polyvinylpyrrolidone polymers, copolymers thereof, and mixtures thereof. The film-forming resins can also comprise functional groups including, but not limited to, carboxylic acid groups, amine groups, epoxide groups, alkoxy groups, hydroxyl groups, thiol groups, carbamate groups, amide groups, urea groups, isocyanate groups (including blocked isocyanate groups), ethylenically unsaturated groups, and combinations thereof.

The polymers of the coating composition can be in particulate or non-particulate form. For instance, the polymers can comprise: (1) core-shell polymeric particles such as, for example, (meth)acrylic core-shell particles comprising a (meth)acrylic shell and a (meth)acrylic core; (2) self-emulsifying dispersion polymer; or a combination thereof.

The polymers of the coating composition can also be dispersed in an aqueous or non-aqueous liquid medium. For instance, the polymers can comprise (meth)acrylic polymers dispersed in an aqueous medium.

As previously described, the film-forming resin of the coating composition is selected to interact with the dried polymeric material. For instance, the film-forming resin can be selected to interact with the dried polymeric material such that at least adhesion is increased between the fibers (treated with the dried polymeric material) and a coating layer formed from the coating composition. The interaction can include a physical interaction such as vander Waals forces and/or hydrogen bonding from functional groups or the type of polymeric backbone of the dried polymeric material and/or the film-forming resin. The interaction can also include a chemical interaction such as from a chemical bond between 2 or more functional groups (i.e., a bond formed from the reaction between at least one functional group on the dried polymeric material and at least one functional group on the film-forming resin). The interaction can include both a physical interaction and a chemical interaction. The interaction can also be provided by a wetting interaction.

The coating composition can also comprise crosslinkers that are reactive with the film-forming resins such as with thermosetting resins. Non-limiting examples of crosslinkers that can be used in the coating composition include carbodiimides, polyhydrazides, aziridines, epoxy resins, alkylated carbamate resins, (meth)acrylates, isocyanates, blocked isocyanates, polyacids, polyamines, polyamides, aminoplasts such as melamine-formaldehyde resins, hydroxyalkyl ureas, hydroxyalkyl amides, and any combination thereof. For instance, the crosslinker can comprise a polyisocyanate, aminoplast, or a combination thereof that is reactive with at least hydroxyl functional groups that can be formed on the film-forming resin. It is appreciated that the film-forming resins can also have functional groups that are reactive with themselves; in this manner, such resins are self-crosslinking.

The coating composition can also include additional components. For example, the coating composition can comprise one or more additional polymers such as a polyol polymer different from the film-forming resin. That is, the coating composition can comprise: (a) core-shell polymeric particles such as, for example, (meth)acrylic core-shell particles comprising a (meth)acrylic shell and a (meth)acrylic core, self-emulsifying dispersion polymer, or a combination thereof; and (b) one or more additional polymers such as one or more polyol polymers different from (a). The polyol polymers can comprise various polymers having at least two hydroxyl groups including, but not limited to, polyether polyols, polyester polyols, polyurethane polyols, (meth) acrylate polyols, copolymers thereof, and combinations thereof. It was found that the additional polyol polymer can improve wetting of the fibers, which in turn improves appearance of the final coating.

The additional polyol polymer can comprise a weight average molecular weight of at least 200 g/mol, at least 400 g/mol, at least 600 g/mol, at least 800 g/mol, or at least 1,000 g/mol. The additional polyol polymer can comprise a weight average molecular weight of 10,000 g/mol or less, 8,000 g/mol or less, 5,000 g/mol or less, or 2,000 g/mol or less. The additional polyol polymer can also comprise a weight average molecular weight within a range such as, for example, of from 200 g/mol to 10,000 g/mol, or from 200 g/mol to 5,000 g/mol, or from 400 g/mol to 2,000 g/mol.

The weight average molecular weight and number average molecular weight are determined by Gel Permeation Chromatography using a Waters 2695 separation module with a Waters 410 differential refractometer (RI detector) and polystyrene standards in which tetrahydrofuran (THF) is used as the eluent at a flow rate of 1 ml/min and two PL Gel Mixed C columns are used for separation.

It is appreciated that when the coating composition comprises multiple additional polyol polymers (e.g. at least two polyol polymers), the polyol polymers can have different molecular weights and which can improve wetting of the fibers. The polyol polymers can be selected such that the lower molecular weight polyol polymer is used in a lower weight % than the higher molecular polyol polymer. Alternatively, the higher molecular weight polyol polymer can be used in a lower weight % than the lower molecular weight polyol polymer.

The additional polyol polymer(s) can comprise at least 0.5 weight %, at least 1 weight %, or at least 2 weight %, based on the total solids weights of the coating composition. The additional polyol polymer(s) can also comprise 20 weight % or less, 15 weight % or less, 10 weight % or less, 8 weight or less, or 5 weight % or less, based on the total solids weight of the coating composition. The additional polyol polymer(s) can further comprise an amount within a range such as, for example, of from 0.5 weight % to 20 weight %, or from 1 weight % to 10 weight %, based on the total solids weight of the coating composition.

The coating composition can also include a colorant such as, for example, any of the pigments, dyes, and/or tints previously described including polymer-enclosed pigment particles. The colorants can comprise various colors including, but limited to, white (e.g. using titanium dioxide), red, blue, black, grey and any combination thereof. The coating composition can also comprise other materials including, but not limited to, plasticizers, abrasion resistant particles, anti-oxidants, hindered amine light stabilizers, UV light absorbers and stabilizers, surfactants, flow and surface control agents, thixotropic agents, organic cosolvents, catalysts, reaction inhibitors, and other customary auxiliaries.

Once applied over the dried polymeric material, the coating composition is dried to form a coating layer. The coating composition can be dried as previously described such as at ambient conditions or with heat. The coating composition can also be cured to form a crosslinked coating layer. The coating composition of the present invention can be cured at ambient conditions, with heat, or with other means such as actinic radiation. The term "actinic radiation" refers to electromagnetic radiation that can initiate chemical reactions. Actinic radiation includes, but is not limited to, visible light, ultraviolet (UV) light, X-ray, and gamma radiation. It will be appreciated that initial drying of the coating composition can cause at least partial curing of the resinous material.

The method of the present invention can also include applying additional coating compositions over the first coating composition to form additional coating layers on the material comprising a plurality fibers. For instance, the method of the present invention can also include applying one or more, two or more, three or more, or four or more, coating compositions over the first coating layer to form additional coating layers.

The additional coating compositions can be formed from any of the previously described materials with respect to the first coating composition. The additional coating compositions can be formed with the same materials or with different materials as to each other and as to the first coating composition. For example, at least some of the additional coating compositions can be prepared with different colorants to provide different colored coating layers. It is appreciated that the coating layers can be applied to provide various orders and combinations of colors and/or special effects, such as metalized (e.g. aluminum) and colored layers.

The additional coating compositions can also be dried and/or cured after applying each additional coating composition. Alternatively, the coating compositions can be dried after each application and then cured together such as with heat.

The coatings formed from the coating compositions as previously described can have a dry film thickness, as taken together, of from 0.1 microns to 127 microns, or from 10 microns to 65 microns. That is, the dry film thickness of each coating layer measured together, whether it is one coating layer or multiple coating layers, can be from 0.1 microns to 127 microns, or from 10 microns to 65 microns.

When multiple coatings are formed over the material comprising fibers, the amount of the polymer in the liquid solution can be increased as compared to the amount of the polymer in the liquid solution when only one coating layer is formed over the material comprising fibers. As such, the amount of the polymer in the liquid solution can be greater when multiple coatings are formed over the material comprising fibers as compared to an amount of the polymer in the liquid solution when only one coating layer is formed over the material comprising fibers.

The method of the present invention can also include a pretreatment step to treat the fibers prior to applying the liquid solution and coating compositions. The fibers can be pretreated individually prior to being associated together, or they can be pretreated after being associated together such as when formed into a woven material. For instance, the fibers can be subjected to a sizing process prior to applying the liquid solution and coating compositions.

As previously described, the liquid solution and coating compositions can be applied to the fibers using various methods. In accordance with the present invention, the method can avoid or eliminate certain types of application processes. For example, the method of the present invention can be free of a vapor deposition process for applying the liquid solution and coating compositions.

The method of the present invention can further include additional processes after applying the coatings. For instance, the method of the present invention can also include a molding process to mold the previously described woven material into an article. The molding process can comprise any molding process known in the art to form the desired article. For example, the coated woven material can be molded into an article by compression molding.

Non-limiting examples of articles that can be formed from the coated woven material include: electronic materials such as laptops, headphones, speakers, and cell phones; automotive interior and exterior car parts such as hoods and dash boards; and sporting goods such as shin guards, hockey sticks, and shoe soles.

It is appreciated that the present invention also relates to a material having a plurality of fibers, such as a woven material, comprising a dried polymeric material formed over at least a portion of the fibers that forms a network of discontinuous dried polymeric particles and at least a first coating layer formed over at least a portion of the dried polymeric material. The dried polymeric material can be formed from the previously described polymers dispersed in the liquid solution. It will be appreciated that any of the previously described additional components that may be included in the liquid solution can also be dried and formed over the woven material along with the dried polymeric material as indicated above. For example, the liquid solution can also include colorants (e.g. polymer-enclosed color-imparting particles), and/or platy inorganic fillers as previously described.

The first coating layer formed over at least a portion of the dried polymeric material of the fibers can be obtained from a first coating composition comprising a film-forming resin that interacts with the dried polymeric material to improve at least adhesion of the first coating layer over the plurality of fibers. The film-forming resin and optional additional materials that form the coating composition can include any of the materials previously described with respect to the coating composition.

The coated material can also comprise additional coating layers including any of the additional coating layers previously described. The additional coating layers can be formed from additional coating compositions comprising the same materials or different materials as each other and as the first coating composition. The resulting coating layers can also have a dry film thickness as previously described.

It will be appreciated that the coated fibers, such as the coated woven material, can be formed from the previously described method. It will also be appreciated that the present invention further relates to a molded article, such as any of the previously described articles, which is prepared from any of the described coated woven materials.

It was found that the coated material comprising a plurality of fibers, such as a woven material, of the present invention exhibited good properties including good flexibility and did not have fibers that were dislodged or deformed from the coating process. In addition, the coated materials also exhibit good visible appearance and thermal stability while maintaining a 3D structure. Moreover, the coated materials exhibited good coloring when colorants were used such as when a white color was selected, for example.

It is appreciated that the previously described material comprising a plurality of fibers, such as a woven material, can be treated using variations of the previously described liquid solution and molded into an article. For example, the material comprising a plurality of fibers can be treated with a liquid solution comprising polymer-enclosed color-imparting particles, in which the particles are selected from organic or inorganic color-imparting particles. The polymer-enclosed color-imparting particles may comprise the only resinous containing material in the liquid solution (i.e. without any other polymeric materials) or, alternatively, additional resins can be included such as any of the resins previously described. The liquid solution may also include any of the previously described non-resinous materials such as the platy inorganic fillers, other colorants, and/or various auxiliaries/additives. Alternatively, the liquid solution may only contain the polymer-enclosed color-imparting particles. It is appreciated that this alternative method would result in a material comprising a plurality of fibers having the dried polymer-enclosed color-imparting particles formed there over and which may form a network of discontinuous dried polymeric particles, such as previously descried, or a continuous coating layer.

The polymer of the polymer-enclosed color-imparting particles can comprise at least 1 weight %, at least 2 weight %, at least 4 weight %, at least 6 weight %, or at least 8 weight % of the liquid solution, based on the total weight of the liquid solution. The polymer of the polymer-enclosed color-imparting particles can comprise 30 weight % or less, 25 weight % or less, 20 weight % or less, 15 weight % or less, or 10 weight % or less of the liquid solution, based on the total weight of the liquid solution. The polymer of the polymer-enclosed color-imparting particles can comprise an amount within a range of from 1 weight % to 30 weight %, or 2 weight % to 20 weight %, or from 4 weight % to 10 weight % of the liquid solution, based on the total weight of the liquid solution.

The treated material can be molded into an article with or without applying any of the previously described coating compositions. For instance, the material comprising a plurality of fibers, such as a woven material, can be treated with the liquid solution (e.g. by dipping into the liquid solution) comprising polymer-enclosed color-imparting particles (for example, as the only resinous containing material), and then molded without applying the previously described coating composition.

The present invention can therefore also comprise a coated material comprising a plurality of fibers comprising dried polymer-enclosed color-imparting particles formed over at least a portion of the fibers (which may form a network of discontinuous dried polymeric particles, such as discontinuous platelets or discontinuous films over the fibers) and that may comprise the only dried polymeric material formed over the fibers. The fibers may comprise any of the previously described fibers, such as carbon fibers or metallized carbon fibers for example. The coated material can then be molded into an article.

The present invention is also directed to the following aspects.

A first aspect is directed to a method for coating a material comprising a plurality of fibers, the method comprising: (a) applying a liquid solution over at least a portion of the fibers of the material, wherein the liquid solution comprises a polymer dispersed in a liquid medium; (b) drying at least a portion of the liquid solution applied over the fibers of the material to obtain a dried polymeric material that forms a network of discontinuous dried polymeric particles over the fibers; (c) applying to at least a portion of the fibers a first coating composition comprising a film-forming resin that interacts with the dried polymeric material; and (d) drying the first coating composition to form a first coating layer over at least a portion of the fibers.

A second aspect is directed to the method of the first aspect, wherein the liquid solution is applied over at least a portion of the fibers of the material by dipping at least a portion of the material into the liquid solution.

A third aspect is directed to the method of the first or second aspects, wherein the liquid solution is substantially free of a cross-linker reactive with the polymer.

A fourth aspect is directed to the method of any one of the previous aspects, wherein the liquid medium comprises an aqueous medium.

A fifth aspect is directed to the method of any one of the previous aspects, wherein the polymer of the liquid solution comprises urethane linkages and/or urea linkages.

A sixth aspect is directed to the method of the fifth aspect, wherein the polymer of the liquid solution comprises polymeric core-shell particles comprising: (i) a polymeric shell comprising the urethane linkages and urea linkages that at least partially encapsulates (ii) a polymeric core comprising an addition polymer obtained from ethylenically unsaturated monomers.

A seventh aspect is directed to the method of any one of the previous aspects, wherein the liquid solution further comprises platy inorganic fillers, and wherein the platy inorganic fillers comprise vermiculite.

An eighth aspect is directed to the method of any one of the previous aspects, wherein the first coating composition further comprises a polyol polymer.

A ninth aspect is directed to the method of any one of the previous aspects, wherein the first coating composition is a crosslinking coating composition that comprises a cross-linker reactive with the film-forming resin.

A tenth aspect is directed to the method of any one of the previous aspects, wherein the first coating composition further comprises a colorant.

An eleventh aspect is directed to the method of the ninth aspect, wherein the film-forming resin comprises a (meth) acrylic polymer comprising one or more functional groups dispersed in an aqueous medium, and wherein the cross-linker is reactive with the one or more functional groups.

A twelfth aspect is directed to the method of any one of the previous aspects, further comprising forming one or more additional coating layers over the first coating layer.

A thirteenth aspect is directed to the method of any one of the previous aspects, wherein the film-forming resin comprises a (meth)acrylic polymer comprising one or more functional groups dispersed in an aqueous medium, and wherein the cross-linker is reactive with the one or more functional groups.

A fourteenth aspect is directed to the method of any one of the previous aspects, wherein an amount of the polymer in the liquid solution is greater when multiple coatings are formed over the fibers as compared to an amount of the polymer in the liquid solution when only the first coating layer is formed over the fibers.

A fifteenth aspect is directed to the method of any one of the previous aspects, wherein the material comprising the plurality of fibers is a woven material.

A sixteenth aspect is directed to the method of any one of the previous aspects, further comprising pretreating the fibers before applying the liquid solution.

A seventeenth aspect is directed to a coated material comprising: a plurality of fibers comprising a dried polymeric material that forms a network of discontinuous dried polymeric particles over the fibers; and a first coating layer formed over at least a portion of the dried polymeric material of the fibers, wherein the first coating layer is formed from a coating composition comprising a film-forming resin that interacts with the dried polymeric material to improve at least adhesion of the first coating layer over the plurality of fibers.

An eighteenth aspect is directed to the coated material of the seventeenth aspect, wherein the dried polymeric material comprises urethane linkages and/or urea linkages.

A nineteenth aspect is directed to the coated material of the eighteenth aspect, wherein the dried polymeric material comprises polymeric core-shell particles comprising: (i) a polymeric shell comprising the urethane linkages and urea linkages that at least partially encapsulates (ii) a polymeric core comprising an addition polymer obtained from ethylenically unsaturated monomers.

A twentieth aspect is directed to the coated material of any one of the eighteenth or nineteenth aspects, further comprising dried platy inorganic fillers formed over at least a portion of the fibers, and wherein the platy inorganic fillers comprise vermiculite.

A twenty first aspect is directed to the coated material any one of the seventeenth through twentieth aspects, wherein the first coating composition further comprises a polyol polymer.

A twenty second aspect is directed to the coated material of the seventeenth through twenty first aspects, wherein the first coating composition is a crosslinking coating composition that comprises a cross-linker reactive with the film-forming resin.

A twenty third aspect is directed to the coated material of the twenty second aspect, wherein the film-forming resin comprises a (meth)acrylic polymer comprising one or more functional groups dispersed in an aqueous medium, and wherein the cross-linker is reactive with the one or more functional groups.

A twenty fourth aspect is directed to the coated material of any one of the seventeenth through twenty third aspects, further comprising one or more additional coating layers formed over the first coating layer.

A twenty fifth aspect is directed to the coated material of any one of the seventeenth through twenty fourth aspects, wherein the first coating composition is a crosslinking coating composition.

A twenty sixth aspect is directed to the coated material of any one of the seventeenth through twenty fifth aspects, wherein the fibers comprise carbon fibers.

A twenty seventh aspect is directed to the coated material of any one of the seventeenth through twenty sixth aspects, wherein the material comprising the plurality of fibers is a woven material.

A twenty eighth aspect is directed to a method for coating a material comprising a plurality of fibers, the method comprising: (a) applying a liquid solution over at least a portion of the fibers of the material, wherein the liquid solution comprises polymer-enclosed color-imparting particles dispersed in a liquid medium; and (b) drying the liquid solution to form dried polymer-enclosed color-imparting particles over at least a portion of the fibers.

A twenty ninth aspect is directed to the method of the twenty eighth aspect, wherein the material comprising the plurality of fibers is a woven material.

A thirtieth aspect is directed to the method of the twenty eighth or twenty ninth aspects, wherein the fibers comprise carbon fibers.

A thirty first aspect is directed to the method of any one of the twenty eighth through thirtieth aspects, wherein the fibers are metallized fibers.

A thirty second aspect is directed to the method of any one of the twenty eighth through thirty first aspects, wherein the polymer-enclosed color-imparting particles are the only polymeric materials in the liquid solution.

A thirty third aspect is directed to a coated material comprising a plurality of fibers comprising dried polymer-enclosed color-imparting particles formed over at least a portion of the fibers.

A thirty fourth aspect is directed to the coated material of the thirty third aspect, wherein the material comprising the plurality of fibers is a woven material.

A thirty fifth aspect is directed to the coated material of the thirty third or thirty fourth aspects, wherein the fibers comprise carbon fibers.

A thirty sixth aspect is directed to the coated material of any one of the thirty third through thirty fifth aspects, wherein the fibers are metallized fibers.

A thirty seventh aspect is directed to the coated material of any one of the thirty third through thirty sixth aspects, wherein the polymer-enclosed color-imparting particles are the only polymeric materials formed over the fibers.

A thirty eighth aspect is directed to the coated material of any one of the thirty third through thirty seventh aspects, wherein the dried polymer-enclosed color-imparting particles form a network of discontinuous dried polymeric particles over the fibers.

A thirty ninth aspect is directed to the coated material of any one of the seventeenth through twenty seventh aspects made by the method of any one of the first through sixteenth aspects.

A fortieth aspect is directed to the coated material of any one of the thirty third through thirty eighth aspects made by the method of any one of the twenty eighth through thirty second aspects.

The following examples are presented to demonstrate the general principles of the invention. The invention should not be considered as limited to the specific examples presented. All parts and percentages in the examples are by weight unless otherwise indicated.

Examples 1-6

Preparation of Treatment Baths

Seven baths for treating woven materials were prepared from the components listed in Table 1.

TABLE 1

| | Amount (grams) | | | | | |
|---|---|---|---|---|---|---|
| Components | Ex. 1 | Ex. 2 | Ex. 3 | Ex. 4 | Ex. 5 | Ex. 6 |
| Polyurethane dispersion [1] | 3.75 | 7.5 | 15 | 15 | 30 | 15 |
| DI water | 300 | 300 | 300 | 300 | 300 | 300 |
| BYK ® 333 [2] | 0 | 0 | 0 | 0.23 | 0 | 0 |
| $TiO_2$ pigment [3] | 0 | 0 | 0 | 1 | 0 | 0 |
| Triton X 100 [4] | 0 | 0 | 0 | 0.05 | 0 | 0 |
| Microlite ® 963 [5] | 0 | 0 | 0 | 0 | 0 | 7.5 |

[1] Keto functional polyurethane-polyurea-acrylic core-shell particles dispersed in deionized water, with a solids content 38.6% and an average particle size of 60 nm. The core-shell particles were prepared according to Example 3 of PCT Publication No. WO 2017/160398, which is incorporated by reference herein.
[2] Silicone surface additive, commercially available from BYK.
[3] Titanium dioxide pigment, commercially available from DuPont.
[4] A nonionic surfactant that has a hydrophilic polyethylene oxide chain and an aromatic hydrocarbon lipophilic or hydrophobic group, commercially available from DOW Chemical Co.
[5] Vermiculite dispersion, commercially available from W.R. Grace & Co.

Each bath of Examples 1-6 was prepared by mixing the components listed in Table 1 in separate vessels and then adding 10-15 ml of each mixture into separate metal basins.

Example 7

Treatment of Woven Materials

Carbon fiber woven mats were first precut to fit within the basins of Examples 1-6. The precut mats were then rinsed with alcohol to remove any impurities or oils and allowed to be wicked of excess fluid. The damp woven fibers were then placed on top of the solutions formed in the basins described in Examples 1-6 to allow the liquid to soak through the woven materials. An additional 10-15 ml volume of each resin bath was poured over top of the woven materials to ensure full coverage. The woven materials were left in the baths for approximately 1 minute before being pulled from the basins. Excess fluid from the baths were allowed to drip off before the fiber materials were transferred to an oven.

The woven mats were dried by laying or hanging the material in the oven in the form of the desired final shape. For flat mats, the wet fibers were hung inside the oven or laid flat on a rack. The fibers were dried to the touch in a 60° C. oven for 30 minutes and allowed to fully dry for 12 hours at ambient conditions.

A blocking test according to ASTM D3354-15 was used to determine the degree of unwanted adhesion existing between two layers of woven mat on the resulting treated substrates. A T-bend test (ASTM D4145) was also performed on woven material to assess flexibility and adhesion of the organic resin to the substrate through bending the fabric 180° and inspecting for fiber breakage. The woven materials were further cut with a blade and visually inspected for fraying. FIG. 1 illustrates fraying from a non-treated woven material as compared with the non-frayed woven material treated according to Example 2.

For Example 1, no unwanted adhesion was present, a T-bend of OT was achieved and little fraying was observed. For Examples 2-6, no unwanted adhesion was present, a T-bend of OT was achieved and no fraying was observed.

Figure 2:
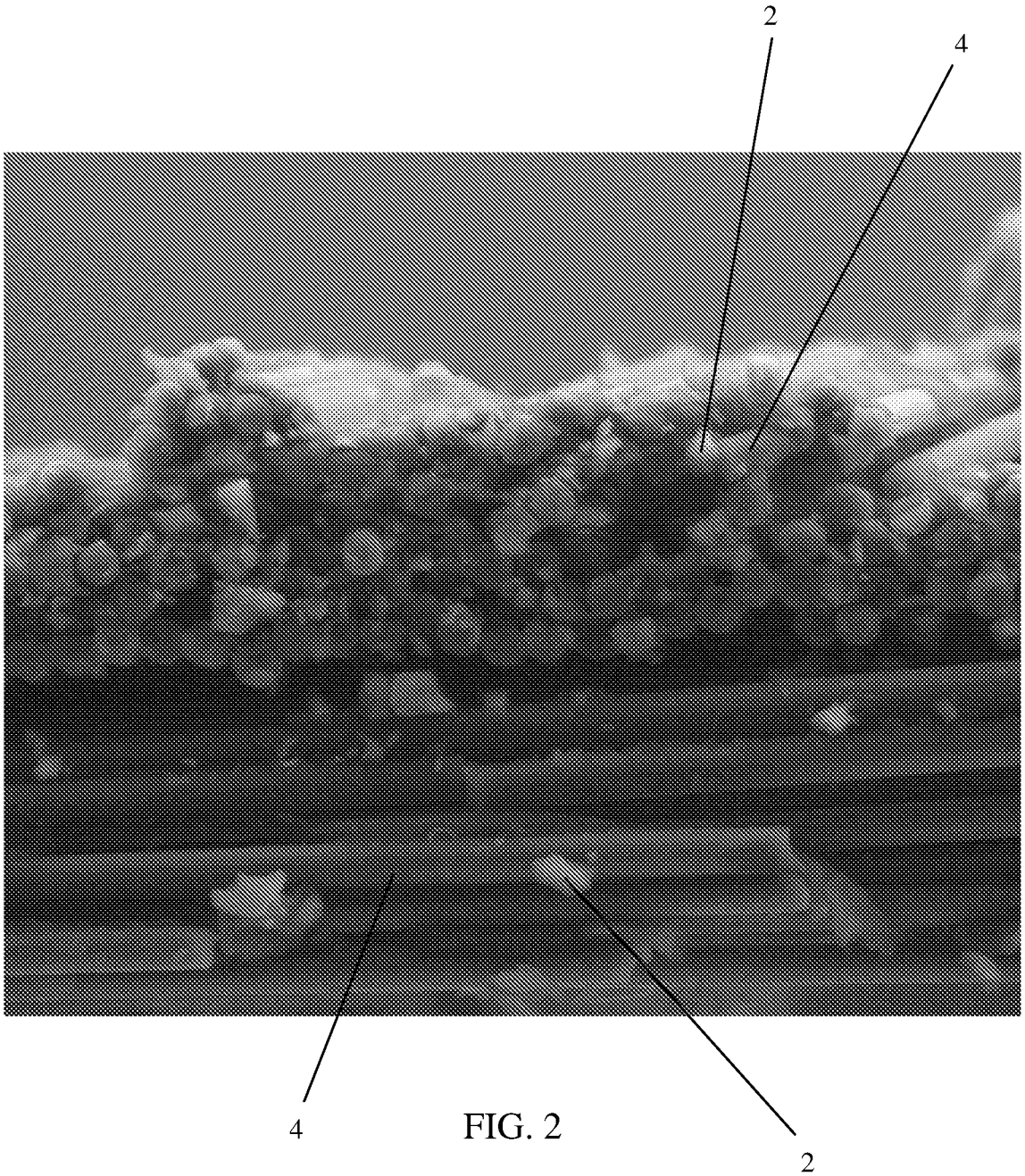
FIG. 2 is a micrographic image via Scanning Electron Microscope (Quanta 250 FEG SEM under high vacuum, with accelerating voltage set to 20.00 kV and a spot size of 3.0) illustrating the resin material being deposited onto the woven material according to the present invention.

The micrograph image illustrated in FIG. 2 further shows the resin deposited onto the woven material treated in Example 5. As shown in FIG. 2, the polymeric material dried on the fibers (4) forms discontinuous platelets (2), which migrates between the fibers (4), acting as adhesion anchors that hold the fibers (4) within each thread and allows for further ease of processing of the woven material.

Example 8

Application of a Coating

The treated woven materials from Example 7 that used the baths from Examples 1-6 were covered with a coating composition comprising a blend of 70 grams of Envirobase® T400 (waterborne hydroxyl functional acrylic latex containing $TiO_2$ pigment, commercially available from PPG Industries), 30 grams of Envirobase® T510 (waterborne hydroxyl functional acrylic latex, commercially available from PPG Industries), and 10 grams of Envirobase® T581 (polyisocyanate crosslinker, commercially available from PPG Industries).

The white coating was spray applied using a conventional Binks Model 95 siphon gun onto the treated woven materials at a range of 20-40 psi atomization pressure. The coated woven mats were then cured in an oven at 60° C. for 10 mins before the addition of additional coating compositions. After application of an additional coating composition, the coated woven mats were placed in an oven at 80° C. for 30 mins for a final cure.

The treated woven materials from Example 1 had only one white coating layer without any fiber fraying during the coating application process (a dry film thickness of 5-7 microns), while the treated woven materials from Example 2 achieved two white coating layers without any fiber fraying and the treated woven materials from Examples 3-5 accommodated five white coating layers without any fiber fraying (a dry film thickness of 20-25 microns).

A blocking test and T-bend test was performed on the woven materials as previously described. A T-bend of T0 was achieved for all samples and the blocking test showed no unwanted adhesion.

Figure 3:
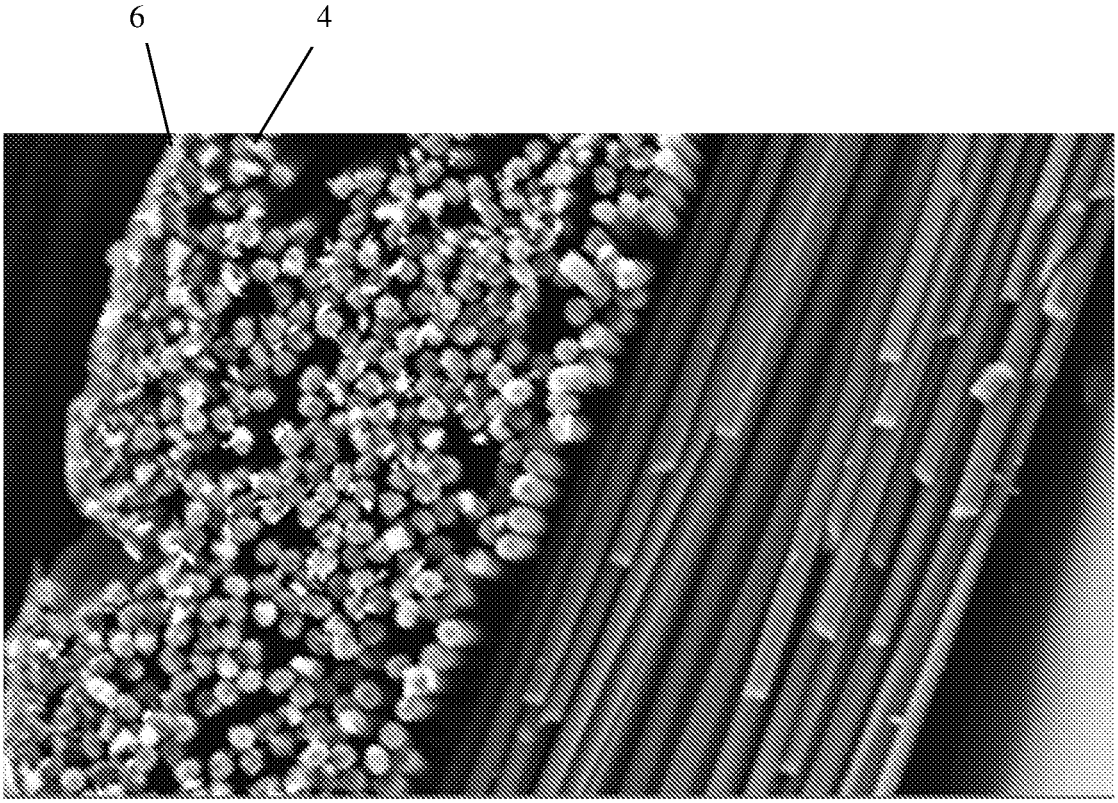
FIG. 3 is a cross-sectional imaging via Scanning Electron Microscope (Quanta 250 FEG SEM under high vacuum, with accelerating voltage set to 20.00 kV and a spot size of 3.0) illustrating the coatings and location of the coatings within the woven material according to the present invention.

Additional cross-sectional imaging was performed for the coated woven material treated according to Example 3 via Scanning Electron Microscope (Quanta 250 FEG SEM under high vacuum, with accelerating voltage set to 20.00 kV and a spot size of 3.0), to confirm the coating stack and location of the coating within the woven material. The imaging is illustrated in FIG. 3 in which the coating (6) is adhered directly over the treated fibers (4).

Adhesion of the coating applied over the treated mats of Example 3 was also tested. During the testing, the coated woven mats previously treated in Example 3, as well as untreated woven mats (control) coated as previously described, were first tested for initial gloss levels with a BYK portable micro-gloss meter capable of 20°, 60°, and 85° angles. The coated woven mats were then subjected to dry double rubs by applying a cheese cloth with a 1000 gram weight ten times back and forth. The gloss levels were then re-measured. The results of the testing are shown in Table 2.

TABLE 2

| Gloss degree | Initial gloss (Control-untreated mat) | Gloss after rubs (Control-untreated mat) | Initial gloss (treated mat) | Gloss after rubs (treated mat) |
|---|---|---|---|---|
| 20° | 1.7 | 0.9 | 2.5 | 2.5 |
| 60° | 6.4 | 3.2 | 5.3 | 5.3 |
| 85° | 3.1 | 0.7 | 1.8 | 2.4 |

As shown in Table 2, the treated woven mats maintained a consistent gloss that corresponds to better adhesion of the coating layer, as compared to the untreated coated woven mats.

Example 9

Application of Multiple Coatings

Treated woven materials from Example 3, utilizing the process from Example 7, were coated with multiple coatings with several layers following the below procedure. First, a layer of a white coating as previously described was applied following Example 8 to coat 20 microns of material. After fully curing this layer according to Example 8, an additional 8 microns of an aluminum coating was applied over the white coating using two coats. The second coating layer was formed from LIQUIDMETAL™ (solvent based coating composition containing aluminum, commercially available from PPG Industries). After application of the second coating composition, the woven sample was baked for 10 minutes at 60° C. Once the first and second coatings were dry a third coating composition was applied. The third coating composition was prepared from the materials comprising blend of 70 grams of Envirobase® T4000 (waterborne hydroxyl functional acrylic latex containing aluminum oxide, commercially available from PPG Industries), 30 grams of Envirobase® T510 (waterborne hydroxyl functional acrylic latex, commercially available from PPG Industries), and 10 grams of Envirobase® T581 (polyisocyanate crosslinker, commercially available from PPG Industries). Two layers, yielding 11 microns, of the third coating layer was achieved followed by a final bake at 60° C. for 30 minutes.

A blocking test and T-bend test was conducted as previously described. T-bend of T0 was achieved for all samples and the blocking test showed no unwanted adhesion.

Adhesion of the coating applied over the treated mats were also tested according to the method previously described. The results of the testing are shown in Table 3.

TABLE 3

| Gloss degree | Initial gloss | Gloss after rubs |
|---|---|---|
| 20° | 1.9 | 1.9 |
| 60° | 4.1 | 4.1 |
| 85° | 3.8 | 4.1 |

As shown in Table 3, the treated woven mats maintained a consistent gloss that corresponds to good adhesion of the coating layer.

Examples 10-16

Application of Coatings

Treated woven materials from Example 3 were coated with white coatings prepared from the components listed in Table 4.

TABLE 4

| Component | Example 10 (grams) | Example 11 (grams) | Example 12 (grams) | Example 13 (grams) | Example 14 (grams) | Example 15 (grams) | Example 16 (grams) |
|---|---|---|---|---|---|---|---|
| Envirobase ® T400[6] | 50 | 50 | 50 | 50 | 50 | 50 | 50 |
| Envirobase ® T510[7] | 21.35 | 13.6 | 14.25 | 25.0 | 13.6 | 21.35 | 21.35 |
| Envirobase ® T581[8] | 7.50 | 6.29 | 6.29 | 7.75 | 5.05 | 9.5 | 12.0 |
| Arcol ® PPG-425[9] | 0 | 0.83 | 0 | 0 | 0 | 0 | 3.88 |
| Dianol ® 260 T[10] | 0 | 0 | 0.84 | 0 | 0 | 0 | 0 |
| Alcupol ® D-1011[11] | 0 | 0 | 0 | 0.99 | 0 | 0 | 0 |
| Vorapel ™ D3201[12] | 0 | 0 | 0 | 0 | 0.82 | 3.77 | 0 |

[6]Waterborne hydroxyl functional acrylic latex containing $TiO_2$ pigment, commercially available from PPG Industries.
[7]Waterborne hydroxyl functional acrylic latex, commercially available from PPG Industries.
[8]Polyisocyanate crosslinker, commercially available from PPG Industries.
[9]Polypropylene glycol having a molecular weight of 425 g/mol, commercially available from Covestro.
[10]Polyether polyol having a molecular weight of 500 g/mol, commercially available from Arkema.
[11]Polypropylene glycol having a molecular weight of 1011 g/mol, commercially available from Repsol.
[12]A polyol polymer having a molecular weight of 2000 g/mol, commercially available from Dow.

The white coatings were spray applied onto the mounted prepared fabric via a conventional siphon feed gun and the resulting coated material was cured in an oven for 10 minutes at 60° C. The resulting samples were tested under a microscope for deformities of coating over the fibers, such as dewetting as well as lightness values under an x-rite color i7, which is related to the amount of dewetting whereby the more dewetting the less bright the sample. The coatings of Examples 10-16, which were formed with polyol polymers, exhibited no dewetting and had a lightness value of 95%, while Example 10, which did not contain a polyol polymer, had a lower lightness value of 90%. It is noted that the coatings of Examples 10-16 contained the same dried film thickness of 30 μm.

Example 17

Molding of an Article

The woven mat treated according to Example 5 via Example 7 and subsequently coated according to Example 8 was compression molded into a polycarbonate (PC) article with the coated woven mat and PC films using compression molding in which the stack was placed between two steel plates in a press heated to 240° C. and an applied pressure of 110 psi was placed on the stack for 5 minutes. The stack was removed from the press and allowed to cool until solidified.

Figure 4A:
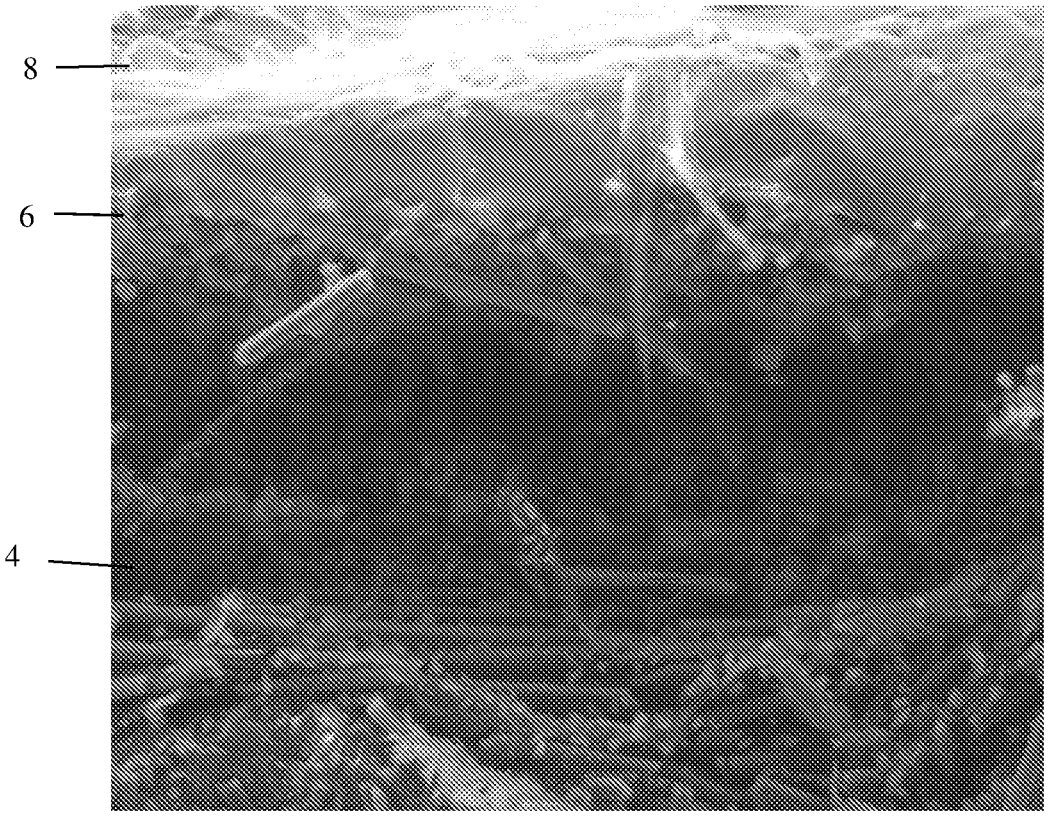
FIG. 4*a* is a cross-sectional imaging via Scanning Electron Microscope (Quanta 250 FEG SEM under high vacuum, with accelerating voltage set to 20.00 kV and a spot size of 3.0) illustrating a polycarbonate article formed with an untreated coated carbon woven mat.
Figure 4B:
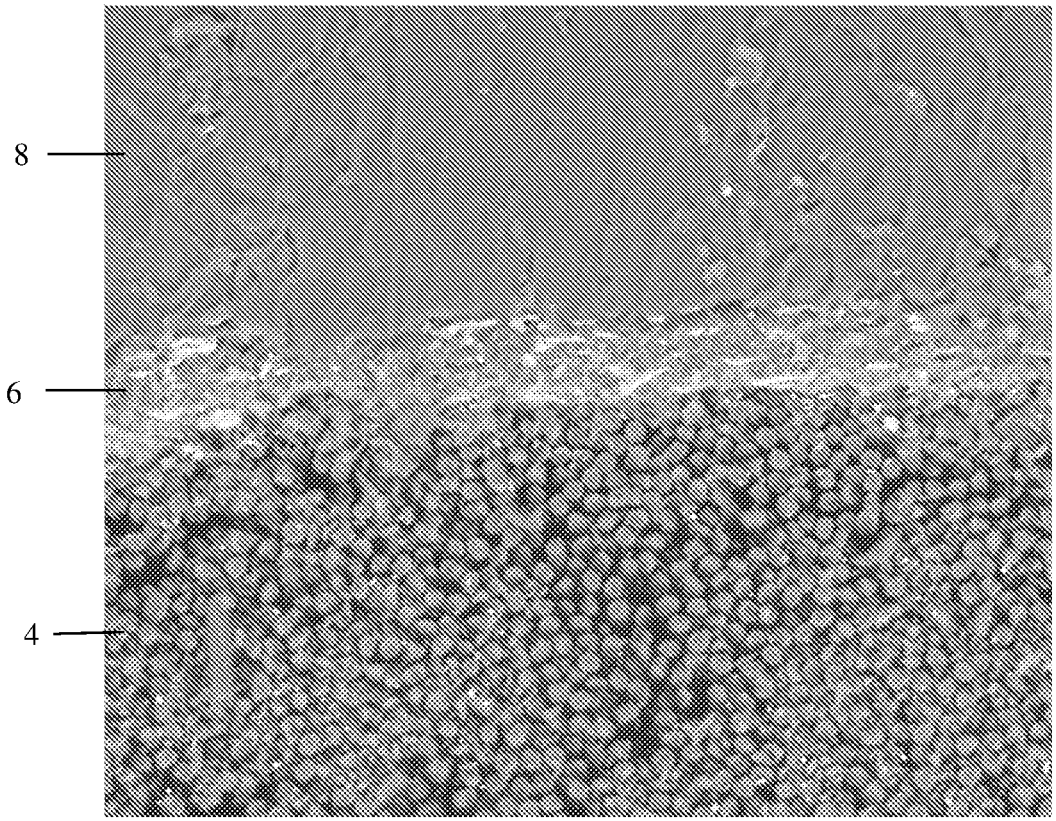
FIG. 4*b* is a cross-sectional imaging via Scanning Electron Microscope (Quanta 250 FEG SEM under high vacuum, with accelerating voltage set to 20.00 kV and a spot size of 3.0) illustrating a polycarbonate article formed with a treated coated carbon woven mat according to the present invention.

Images shown in FIGS. 4*a* and 4*b* are comparison of cross-sectional SEM images Scanning Electron Microscope (Quanta 250 FEG SEM under high vacuum, with accelerating voltage set to 20.00 kV and a spot size of 3.0) from a control sample without any treatment and a sample treated with Example 5 via Example 7, respectively. The images show the molded PC (8) along with the fibers (4) respective coating (6). As shown in FIG. 4*a*, the control sample (untreated native woven material), exhibits several air pockets or voids where the polycarbonate did not wet out the mat. Example 5 shown in FIG. 4*b*, in comparison, shows less air pockets and exhibits an overall improved wet out.

Whereas particular embodiments of this invention have been described above for purposes of illustration, it will be evident to those skilled in the art that numerous variations of the details of the present invention may be made without departing from the invention as defined in the appended claims.

The invention claimed is:

1. A method for coating a material in the form of a mat, the mat comprising a plurality of woven or nonwoven carbon fibers, the method comprising:

(a) applying a liquid solution over at least a portion of the fibers of the material, wherein the liquid solution comprises a polymer dispersed in a liquid medium, and wherein the polymer comprises polymeric core-shell particles comprising: (i) a polymeric shell comprising urethane linkages and urea linkages that at least partially encapsulates (ii) a polymeric core comprising an addition polymer obtained from ethylenically unsaturated monomers;

(b) drying at least a portion of the liquid solution applied over the fibers of the material to obtain a dried, non-crosslinked polymeric material that forms a network of discontinuous dried polymeric particles over the fibers;

(c) applying to at least a portion of the fibers a first coating composition comprising a film-forming resin that interacts with the dried polymeric material via vander Waals forces, hydrogen bonding, and/or chemical bonding by reaction between at least one functional group on the dried, non-crosslinked polymeric material and at least one functional group on the film-forming resin; and (d) drying the first coating composition to form a first coating layer over at least a portion of the fibers.

2. The method of claim 1, wherein the liquid medium comprises an aqueous medium.

3. The method of claim 1, wherein the liquid solution further comprises platy inorganic fillers, and wherein the platy inorganic fillers comprise vermiculite.

4. The method of claim 1, wherein the first coating composition further comprises a polyol polymer.

5. The method of claim 1, wherein the first coating composition is a crosslinking coating composition that comprises a cross-linker reactive with the film-forming resin.

6. The method of claim 1, wherein the first coating composition further comprises a colorant.

7. The method of claim 5, wherein the film-forming resin comprises a (meth)acrylic polymer comprising one or more functional groups dispersed in an aqueous medium, and wherein the cross-linker is reactive with the one or more functional groups.

8. The method of claim 1, further comprising forming one or more additional coating layers over the first coating layer.

9. The method of claim 1, wherein the mat comprising the plurality of woven or nonwoven carbon fibers is a moldable, woven material.

10. The method of claim 1, further comprising pretreating the fibers before applying the liquid solution.

11. A coated, moldable material in the form of a mat, the mat comprising: a plurality of woven or nonwoven carbon fibers and a dried, non-crosslinked polymeric material in the form of a network of discontinuous dried polymeric particles over the fibers, wherein the dried, non-crosslinked polymeric material comprises polymeric core-shell particles comprising: (i) a polymeric shell comprising urethane linkages and urea linkages that at least partially encapsulates (ii) a polymeric core comprising an addition polymer obtained from ethylenically unsaturated monomers; and a first coating layer formed over at least a portion of the dried polymeric material on the fibers, wherein the first coating layer is formed from a first coating composition comprising a film-forming resin that interacts with the dried polymeric material via vander Waals forces, hydrogen bonding, and/or chemical bonding by reaction between at least one functional group on the dried, non-crosslinked polymeric material and at least one functional group on the film-forming resin, to improve at least adhesion of the first coating layer over the plurality of fibers.

12. The coated material of claim 11, wherein the first coating composition is a crosslinking coating composition that comprises a cross-linker reactive with the film-forming resin.

13. The coated material of claim 11, wherein the mat comprising the plurality of fibers is a woven material.

14. The coated material of claim 11, further comprising dried platy inorganic fillers formed over the fibers, and wherein the platy inorganic fillers comprise vermiculite.

15. The coated material of claim 11, wherein the first coating composition further comprises a polyol polymer.

16. The coated material of claim 11, wherein the first coating composition further comprises a colorant.

17. The coated material of claim 12, wherein the film-forming resin comprises a (meth)acrylic polymer comprising one or more functional groups dispersed in an aqueous medium, and wherein the cross-linker is reactive with the one or more functional groups.

18. The coated material of claim 11, further comprising one or more additional coating layers formed over the first coating layer.

* * * * *